US007304271B2

(12) United States Patent
Cho et al.

(10) Patent No.: US 7,304,271 B2
(45) Date of Patent: Dec. 4, 2007

(54) HEATING APPARATUS FOR COOKING AND METHOD FOR CONTROLLING THE SAME

(75) Inventors: Pung Yeon Cho, Suwon (KR); Kobayashi Shozo, Suwon (KR); Seok Weon Hong, Yongin (KR); Yun Ic Hwang, Suwon-Si (KR); Yu Jeub Ha, Suwon-Si (KR); Cheol Jin Kim, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/475,065

(22) Filed: Jun. 27, 2006

(65) Prior Publication Data

US 2006/0237428 A1 Oct. 26, 2006

Related U.S. Application Data

(62) Division of application No. 11/122,049, filed on May 5, 2005, now Pat. No. 7,091,454.

(30) Foreign Application Priority Data

Jul. 14, 2004 (KR) ..... 2004-54842

(51) Int. Cl.
*A21B 1/00* (2006.01)

(52) U.S. Cl. ..... 219/401; 126/20

(58) Field of Classification Search ..... None
See application file for complete search history.

(56) References Cited

U.S. PATENT DOCUMENTS

| | | | | |
|---|---|---|---|---|
| 4,449,026 | A | 5/1984 | Satoh | 219/682 |
| 5,680,810 | A | 10/1997 | Sham | 99/330 |
| 5,786,577 | A | 7/1998 | Han et al. | 219/682 |
| 6,100,502 | A | 8/2000 | Sham et al. | 219/401 |
| 6,909,071 | B2 | 6/2005 | Shozo | 219/401 |
| 6,972,397 | B2 | 12/2005 | Ha | 219/401 |
| 7,091,454 | B2 * | 8/2006 | Cho et al. | 219/401 |
| 2006/0249136 | A1 * | 11/2006 | Reay | 126/20 |

FOREIGN PATENT DOCUMENTS

DE 4303656 A1 * 8/1994

(Continued)

*Primary Examiner*—Thor S. Campbell
(74) *Attorney, Agent, or Firm*—Staas & Halsey LLP

(57) ABSTRACT

A heating apparatus for cooking using steam and a method of controlling the same. The heating apparatus includes a main body having a cooking chamber; a steam-generating device for supplying steam to the cooking chamber; and a water supply device for supplying water to the steam-generating device, having a water bucket for containing water; a water bucket-supporting device installed on the main body for supporting the water bucket, and including a space for containing an inlet of the water bucket such that the inlet can be soaked in the water when the water bucket is inserted into the water bucket-supporting device such that the inlet of the water bucket faces a bottom of the bucket-supporting device; a water supply pump for supplying the water of the water bucket-supporting device to the steam-generating device; and water supply pipes for guiding the water from the water bucket-supporting device to the steam-generating device. The method controls removal of residual water of the steam-generating device and the water supply device, and a time for supplementing water of the water supply device.

8 Claims, 9 Drawing Sheets

FOREIGN PATENT DOCUMENTS

| | | | |
|---|---|---|---|
| DE | 4420821 | | 12/1995 |
| DE | 19741881 | A1 * | 3/1999 |
| EP | 0277337 | | 9/1991 |
| JP | 8-178298 | | 7/1996 |
| JP | 9-4849 | | 1/1997 |
| JP | 2004-20005 | | 1/2004 |
| KR | 58498 | | 10/2000 |

* cited by examiner

HEATING APPARATUS FOR COOKING AND METHOD FOR CONTROLLING THE SAME

CROSS-REFERENCE TO RELATED APPLICATIONS

This application is a divisional application of application Ser. No. 11/122,049 filed May 5, 2005, now U.S. Pat. No. 7,091,454 the disclosure of which is incorporated herein by reference. This application claims the benefit of Korean Patent Application No. 2004-54842, filed Jul. 14, 2004, in the Korean Intellectual Property Office, the disclosure of which is incorporated herein by reference.

BACKGROUND OF THE INVENTION

1. Field of the Invention

The present invention relates to a heating apparatus for cooking, and more particularly to a heating apparatus for cooking having an improved water supply device for supplying water to a steam-generating device, and a method for controlling the same.

2. Description of the Related Art

Generally, heating apparatuses for cooking include an electronic oven range, an electric oven range, and a gas oven range, for example. The electronic oven range, i.e., a microwave oven, supplies high-frequency waves generated from a magnetron to the inside of a cooking chamber, thereby cooking foods placed in the cooking chamber using heat generated from the foods themselves. The electric oven range or the gas oven range transmits heat, generated from the operation of an electric heater or the combustion of a gas, to the inside of a cooking chamber, thereby cooking foods in the cooking chamber. Since moisture of the foods is evaporated during cooking, the above heating apparatuses for cooking are disadvantageous in that the foods are easily dried. Thus, a steam-generating device for preventing foods from being dried and improving cooking effects is installed in the heating apparatuses for cooking.

EP Patent No. 0277337 discloses a heating apparatus for cooking comprising a steam-generating device having a container shape installed on the bottom of a cooking chamber, and a water tank in a drawer-type installed above the cooking chamber for supplying water to the steam-generating device. Japanese Patent Laid-open No. 2004-20005 discloses a heating apparatus using high-frequency waves comprising an evaporation tray installed on the bottom of a cooking chamber, a heater for heating water in the evaporation tray, and a water tank installed at a side of the cooking chamber for supplying water to the evaporation tray. The above heating apparatuses supply water from the water tank to the steam-generating device or the evaporation tray, heat the water, supplied to the steam-generating device or the evaporation tray, using the heater to generate steam, and then supply the steam to the cooking chamber.

Since the water tanks of the above-described heating apparatuses for cooking are not exposed to the outside, a user cannot check a quantity of residual water in the water tank and it is difficult to determine a time for supplying water to the water tank. Further, the filling of the water tank with water causes the user inconvenience.

When the operation of the above-described heating apparatuses is terminated during cooking using steam, residual water often remains in the steam-generating device. When the heating apparatus is not operated for a long period of time under and the residual water remains in the steam-generating device, the residual water in the steam-generating device eventually becomes contaminated and causes hygienic problems. Further, when the replacement of the water filling the water tank of the heating apparatuses is not performed for a long period of time, the inside of the water tank becomes incrusted with harmful biological material and this biological material also causes hygienic problems.

Thus, there is a need for a heating apparatus for cooking, which informs a user of a time for supplying water and easily performs water supply, and a control method thereof. There is also a need for a heating apparatus for cooking, in which residual water does not remain in a steam-generating device and a water supply device after cooking using steam is terminated, and a control method thereof. Further, there is a need for a heating apparatus for cooking, which informs a user of a time for replacing water of the water supply device with new water, and a control method thereof.

BRIEF SUMMARY

In accordance with an aspect of the present invention, there is provided a heating apparatus for cooking, including: a main body having a cooking chamber; a steam-generating device supplying steam to the cooking chamber; and a water supply device supplying water to the steam-generating device. The water supply device includes: a water bucket containing water; a water bucket-supporting device installed on the main body supporting the water bucket, and including a space containing an inlet of the water bucket such that the inlet is soaked in the water when the water bucket is inserted into the water bucket-supporting device such that the inlet of the water bucket faces a bottom of the bucket-supporting device; a water supply pump supplying the water of the water bucket-supporting device to the steam-generating device; and water supply pipes guiding the water from the water bucket-supporting device to the steam-generating device.

The water bucket-supporting device may include: a switching member installed on the upper portion of the front surface of the main body for opening and closing the front surface of the main body; and a water container connected to an inner surface of the switching member and drawn forwards for receiving the inlet of the water bucket when the front surface of the main body is opened.

The heating apparatus may also include an inlet switching device, detachably attached to the inlet of the water bucket, including a valve member opened when the water bucket is put into the water container and closed when the water bucket is separated from the water container.

The water container may include a supporter installed in the inner surface of the water container for supporting a lower end of the inlet switching device; and a protrusion formed on the supporter for pressing the valve member so as to open the inlet of the water bucket when the water bucket is put into the water container.

The heating apparatus for cooking may also include a weight sensor installed in the supporter for sensing a weight of the water bucket when the water bucket is installed on the water bucket-supporting device.

The valve member may include a valve plate moving back and forth for opening and closing a path of the inlet switching device; and a supporting rod, having a designated length and moving back and forth, provided with one end fixed to the valve plate for supporting the valve plate.

According to another aspect of the present invention, there is provided a method of controlling a heating apparatus for cooking which includes a main body having a cooking chamber, a steam-generating device for supplying steam to the cooking chamber, and a water supply device for supplying water to the steam-generating device and having a water bucket detachably attached to the main body for containing water, a sensor for determining whether or not the water bucket is attached to the main body and sensing a weight of the water bucket, and a water supply pump for supplying water to the steam-generating device. The method includes: determining whether the water bucket is installed on the main body using the sensor on receipt of a steam generating instruction; measuring an elapsed time since an installation of the water bucket when the water bucket is determined to be installed on the main body; determining whether the elapsed time exceeds a designated time; and sounding an alarm when the elapsed time is determined to exceed the designated time.

The method may also include sounding an alarm indicating non-installation of the water bucket on the main body when it is determined that the water bucket is not installed on the main body.

The method may also include operating the water supply pump for supplying water to the steam-generating device when it is determined that the installation time of the water bucket does not exceed the designated time.

The method may also include determining whether or not a quantity of the water in the water bucket is sufficient using the sensor before the operation of the water supply pump, and operating the water supply pump when it is determined that the quantity of the water in the water bucket is sufficient.

The method may also include sounding an alarm to supplement the water when it is determined that the quantity of the water in the water bucket is insufficient.

a method of controlling a heating apparatus for cooking which includes a main body having a cooking chamber, a steam-generating device for supplying steam to the cooking chamber, the steam-generating device including a heating tank, a water level sensor for sensing a level of water in the heating tank, and a steam-generating heater for heating the water in the heating tank, and a water supply device, for supplying water to the steam-generating device, the water supply device including a water bucket detachably attached to the main body for containing water, a sensor for determining whether the water bucket is attached to the main body and sensing a weight of the water bucket, and a water supply pump for supplying water to the steam-generating device. The method includes: determining whether the water bucket is separated from the main body using the sensor on receipt of a water removal instruction; operating the water supply pump for a specified time so that the water of the water bucket-supporting device is supplied to the heating tank when the water bucket is determined to be separated from the main body; and operating the steam-generating heater to convert the water in the heating tank into steam.

The method may also include sensing whether or not residual water remains in the heating tank using the water level sensor after the operation of the steam-generating heater; and continuously operating the steam-generating heater when the residual water remains in the heating tank, and terminating the operation of the steam-generating heater when the residual water does not remain in the heating tank.

The method may also include sounding an alarm indicating non-separation of the water bucket from the main body when it is determined that the water bucket is not separated from the main body.

According to another aspect of the present invention, there is provided a method of controlling steam generation, including: determining, after receipt of a steam generating instruction, whether a water bucket is installed on a main body using the sensor on receipt of a steam generating instruction; measuring an elapsed time since an installation of the water bucket when the water bucket is determined to be installed on the main body; determining whether the elapsed time exceeds a designated time; and sounding an alarm when the elapsed time is determined to exceed the designated time.

According to another aspect of the present invention, there is provided a method of controlling removal of residual water, including: determining whether a water bucket is separated from a main body; delivering residual water from the water bucket to a heating tank for a designated time; heating the water in the heating tank to convert the water into steam; and determining, during the heating, whether residual water remains in the heating tank and repeating the heating when residual water is determined to be in the heating tank.

Additional and/or other aspects and advantages of the present invention will be set forth in part in the description which follows and, in part, will be obvious from the description, or may be learned by practice of the invention.

BRIEF DESCRIPTION OF THE DRAWINGS

These and/or other aspects and advantages of the present invention will become apparent and more readily appreciated from the following detailed description, taken in conjunction with the accompanying drawings of which.

DETAILED DESCRIPTION OF EMBODIMENT

Figure 1:
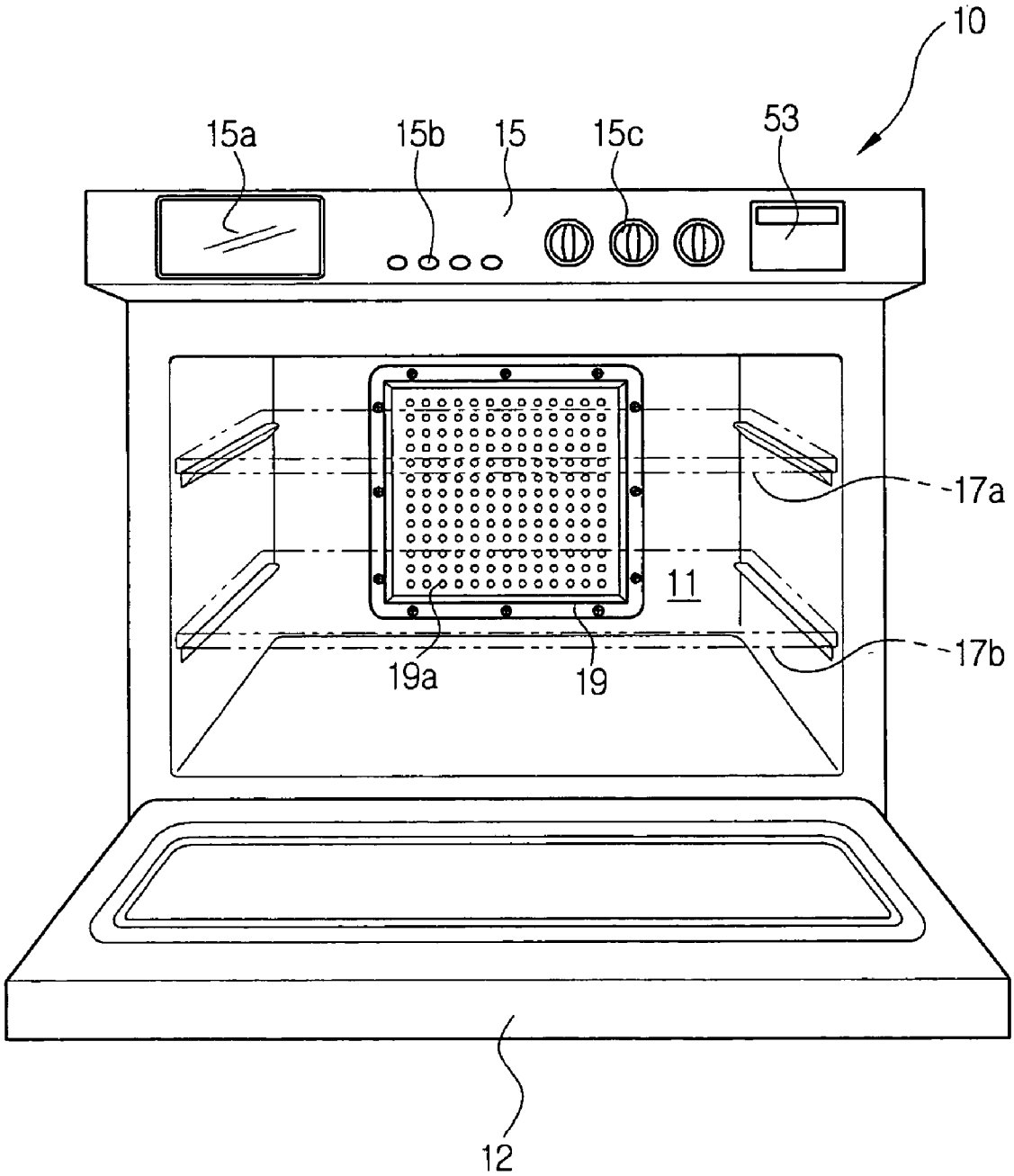
FIG. 1 is a perspective view illustrating a front appearance of a heating apparatus for cooking in accordance with an embodiment of the present invention.

Reference will now be made in detail to an embodiment of the present invention, examples of which are illustrated in the accompanying drawings, wherein like reference numerals refer to the like elements throughout. The embodiment is described below in order to explain the present invention by referring to the figures.

Figure 2:
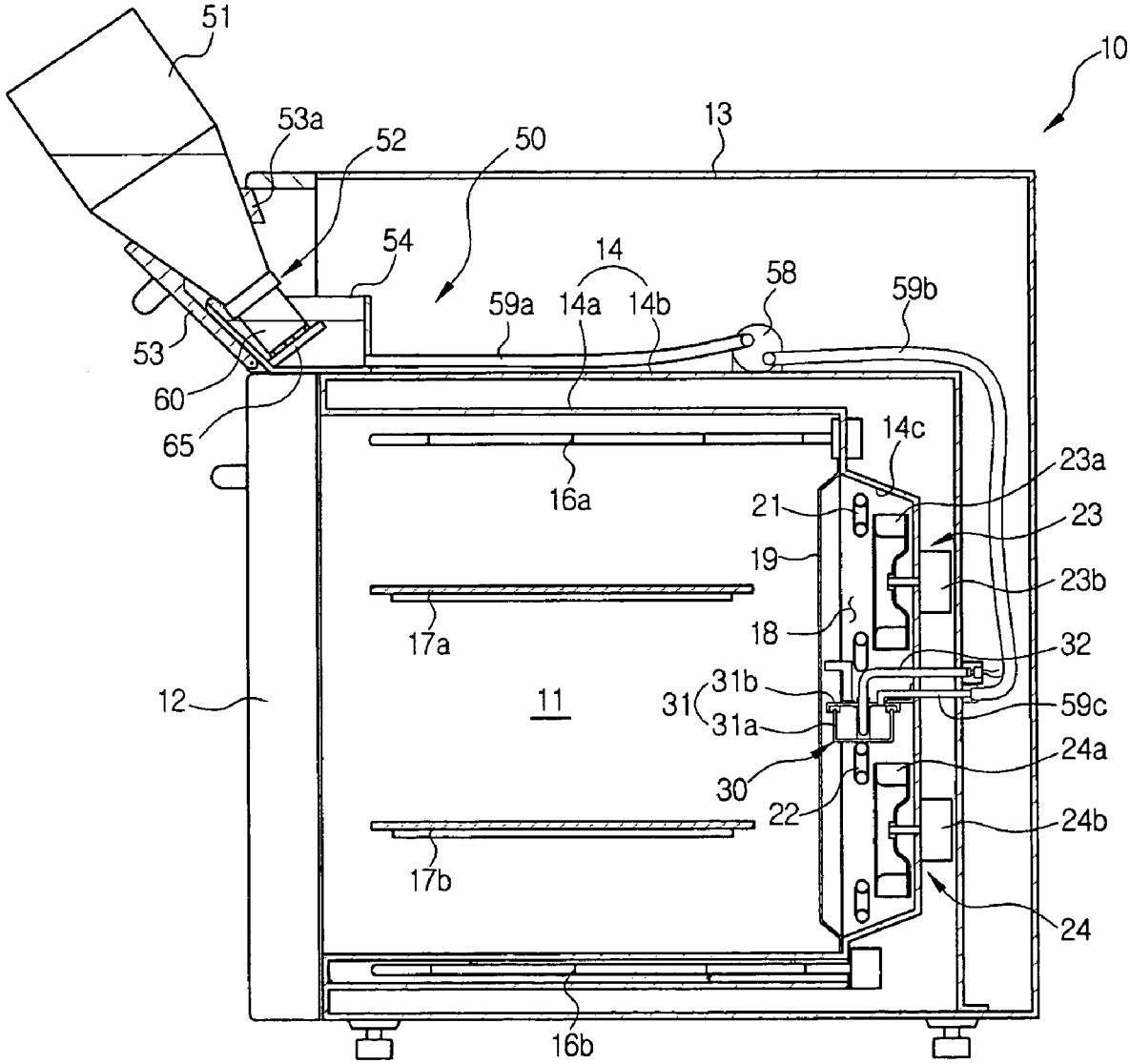
FIG. 2 is a cross-sectional view of the heating apparatus for cooking of FIG. 1.

As shown in FIGS. 1 and 2, a heating apparatus for cooking (an over) in accordance with the present invention includes a main body 10 having a cooking chamber 11 installed therein, and a door 12 vertically rotatably installed on the front surface of the main body 10 for closing the opened front surface of the cooking chamber 11. The heating apparatus for cooking also includes a hot air chamber 18 installed at the rear portion of the inside of the cooking chamber 11, first and second heaters 21 and 22 installed in the hot air chamber 18, first and second blowing devices 23 and 24 for circulating air of the cooking chamber 11 into the hot air chamber 18, a steam-generating device 30 installed in the hot air chamber 18 for supplying steam to the cooking chamber 11, and a water supply device 50 installed at the upper portion of the cooking chamber 11 for supplying water to the steam-generating device 30.

The main body 10 includes an outer case 13 which may be made of an iron plate, and an inner case 14 installed in the outer case 13 such that the outer surface of the inner case 14 is separated from the inner surface of the outer case 13 for forming the cooking chamber 11. The inner case 14 has a first case 14*a* forming the inner surface of the inner case 14 and a second case 14*b* forming the outer surface of the inner case 14, which are separated from each other. A space is formed between the first case 14*a* and the second case 14*b*, thereby thermally insulating the cooking chamber 11 from the outside. As shown in FIG. 1, an operating unit 15 including a display 15*a* for displaying the operational state of the heating apparatus for cooking, various operating buttons 15*b*, and manipulation switches 15*c* is installed at the upper part of the door 12 on the front surface of the main body 10.

Shelves 17*a* and 17*b* for placing foods thereon are respectively installed at upper and lower portions of the inside of the cooking chamber 11. An upper heater 16*a* and a lower heater 16*b* for heating the foods placed on the shelves 17*a* and 17*v* are respectively installed at the upper and lower portions of the inside of the cooking chamber 11. Here, the upper heater 16*a* is installed at the upper portion of the inside of the cooking chamber 11, and the lower heater 16*b* is on the outer lower surface of the cooking chamber 11. That is, the lower heater 16*b* contacts the outer surface of the bottom of the first case 14*a*. The above structure protects the lower heater 16*b* from foreign substances falling from the foods placed in the cooking chamber 11, and transmits heat of the lower heater 16*b* to the inside of the cooking chamber 11 through the bottom of the first case 14*a*.

As shown in FIG. 2, the hot air chamber 18 installed at the rear portion of the inside of the cooking chamber 11 is formed by a depression 14*c* formed in the rear surface of the first case 14*a* by a designated depth. A hot air chamber cover 19, provided with a plurality of air vents 19*a* (in FIG. 1) formed therethrough, is detachably installed on the rear surface of the inside of the cooking chamber 11 such that the hot air chamber cover 19 covers the front surface of the hot air chamber 18. Although the hot air chamber 18 of this embodiment of the present invention is formed at the rear portion of the inside of the cooking chamber 11, the hot air chamber 18 may be formed at either of the side surfaces of the cooking chamber 11.

The first and second blowing devices 23 and 24, for circulating air to the hot air chamber 18, respectively include first and second air blast fans 23*a* and 24*a* installed at upper and lower portions of the inside of the hot air chamber 18, and first and second driving motors 23*b* and 24*b* installed at the outer surface of the rear portion of the hot air chamber 18 for driving the first and second air blast fans 23*a* and 24*a*. The first heater 21 in the hot air chamber 18 is installed adjacent to the outer periphery of the upper first air blast fan 23*a*, and the second heater 22 in the hot air chamber 18 is installed adjacent to the outer periphery of the lower second air blast fan 24*a*. When the first and second air blast fans 23*a* and 24*a* are operated when the first and second heaters 21 and 22 are operated, the air in the cooking chamber 11 is circulated into the hot air chamber 18 and heated by the first and second heaters 21 and 22. The above circulation of the hot air improves the cooking effects of the foods placed in the cooking chamber 11.

Figure 3:
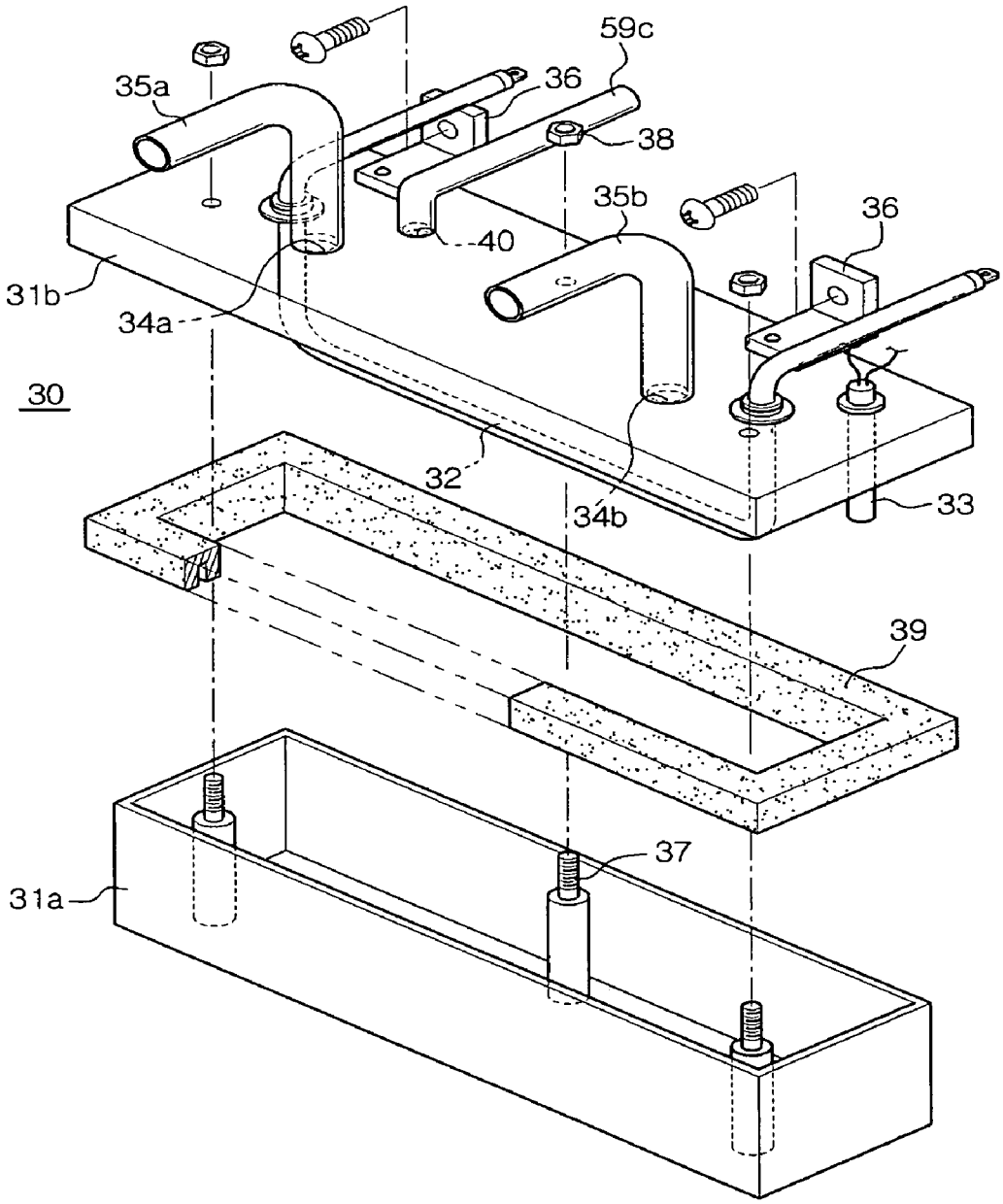
FIG. 3 is an exploded perspective view of a steam-generating device of the heating apparatus for cooking of FIG. 1.

The steam-generating device 30 is installed in the central portion of the hot air chamber 18 between the first heater 21 and the second heater 22. As shown in FIGS. 2 and 3, the steam-generating device 30 includes a heating tank 31 containing a designated quantity of water, a steam-generating heater 32 for heating the water contained in the heating tank 31, and a water level sensor 33 for sensing a water level in the heating tank 31.

The heating tank 31 includes a heating container 31*a* having a rectangular hexahedral structure provided with an opened upper surface for containing water, and a cover member 31*b* provided with steam exhaust holes 34*a* and 34*b* respectively formed at both sides thereof for closing the opened upper surface of the heating container 31*a*. Here, the cover member 31*b* is fixed to the inner rear surface of the hot air chamber 18 through fixing members 36 installed at upper portions of the rear surfaces of both sides thereof, and the heating container 31*a* is detachably attached to the lower portion of the cover member 31*b*. For this reason, a plurality of fixing bolts 37, which are extended upwardly, are fixed to the inside of the heating container 31*a*. After upper ends of the fixing bolts 37 pass through the cover member 31*b*, fixing nuts 38 are respectively coupled with the upper ends of the corresponding fixing bolts 37, thereby fixing the fixing bolts 37. A packing 39 for maintaining an airtight state is interposed between the upper end of the heating container 31*a* and the cover member 31*b*.

Both ends of the steam-generating heater 32 are fixed to the cover member 31*b* such that the main portion of the steam-generating heater 32 can be soaked in the water in the heating container 31*a*, and an end of the water level sensor 33 is fixed to the cover member 31*b* such that the main portion of the water level sensor 33 can be soaked in the water in the heating container 31*a*. A water supply hole 40 for supplying water to the heating container 31*a* therethrough is formed through the cover member 31*b*, and a water supply pipe 59*c* of the water supply device 50, which will be described later, is connected to the water supply hole 40. Exhaust guide pipes 35*a* and 35*b* having a designated length for guiding the exhaust of steam are respectively connected to steam exhaust holes 34*a* and 34*b* formed at both sides of the cover member 31*b*.

The steam-generating device 30 generates steam by heating water supplied to the heating tank 31*a* using the steam-generating heater 32, and supplies the steam to the cooking chamber 11 through the exhaust guide pipes 35*a* and 35*b*. The above steam-generating device 30 heats the outer surface of the heating tank 31 using the first and second heaters 21 and 22, thereby increasing efficiency in generating the steam, and uniformly supplies the steam exhausted through the exhaust guide pipes 35*a* and 35*b* to the cooking chamber 11 using the air circulating into the hot air chamber 18, thereby improving cooking effects.

Figure 4:
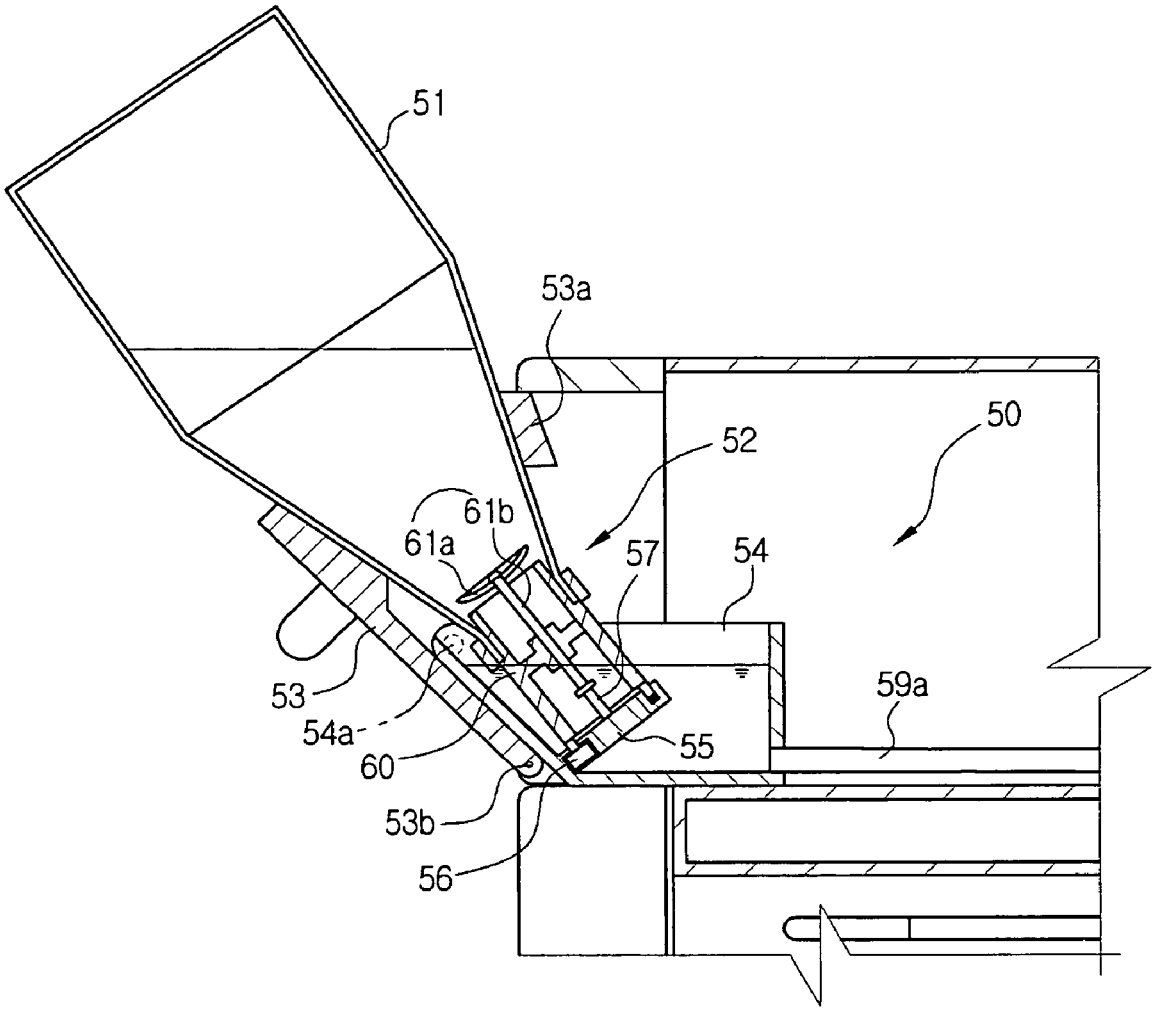
FIG. 4 is a cross-sectional view of a water bucket-supporting device, on which a water bucket is installed, of the heating apparatus for cooking of FIG. 1.

As shown in FIGS. 2 and 4, the water supply device 50 placed in the upper portion of the cooking chamber 11 includes a water bucket 51 having a bottle structure made of a transparent material, a water bucket-supporting device 52 placed on the upper portion of the front surface of the main body 10 for supporting the water bucket 51, a water supply pump 58 for supplying water of the water bucket-supporting device 52 to the heating tank 31 of the steam-generating device 30, and a plurality of water supply pipes 59*a*, 59*b* and 59*c* for connecting the water bucket-supporting device 52 and the water supply pump 58 and connecting the water supply pump 58 and the heating tank 31.

Figure 5:
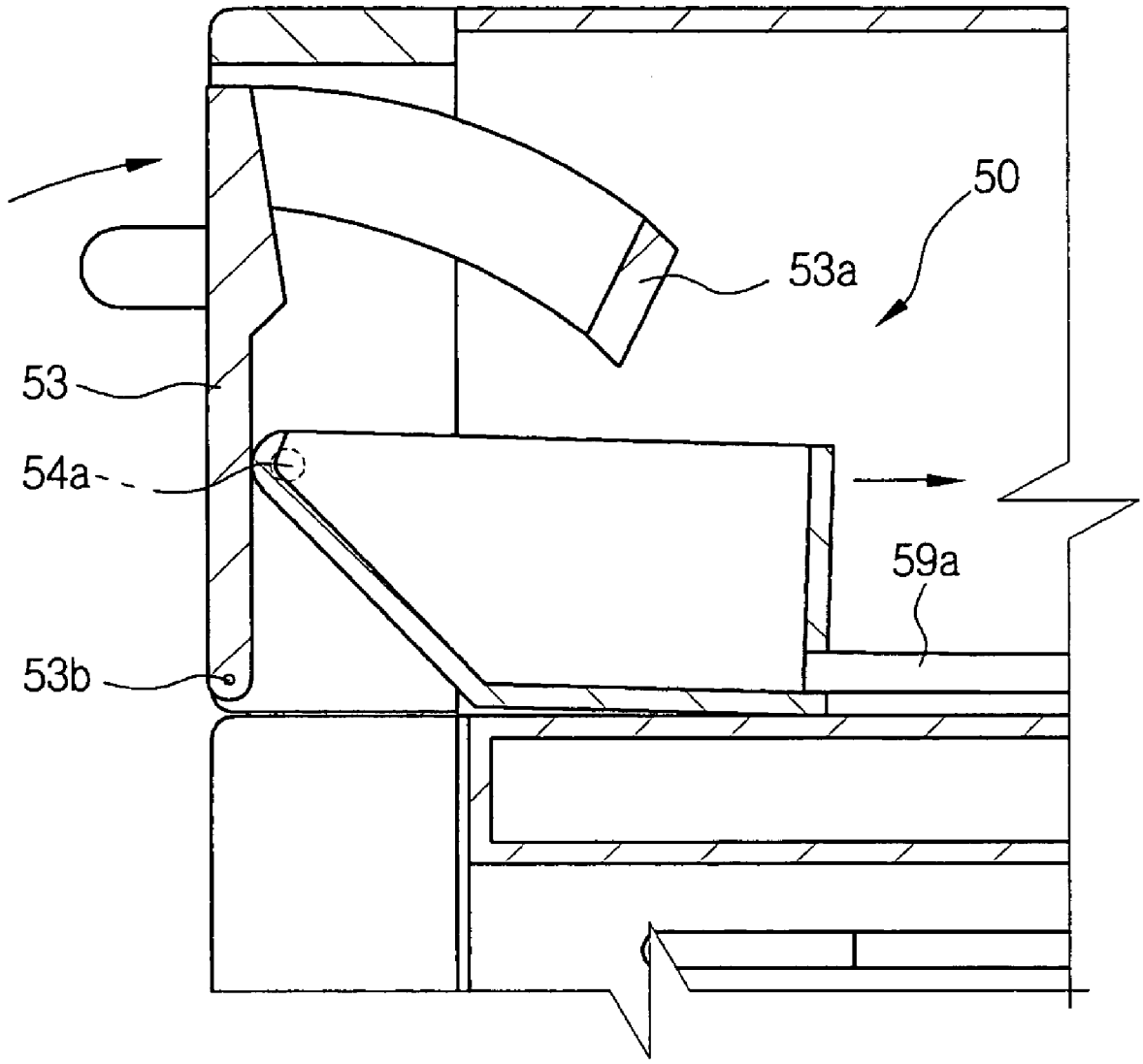
FIG. 5 is a cross-sectional view of the water bucket-supporting device, from which the water bucket is separated, and, which is closed by a switching member, of the heating apparatus for cooking of FIG. 1.
Figure 7:
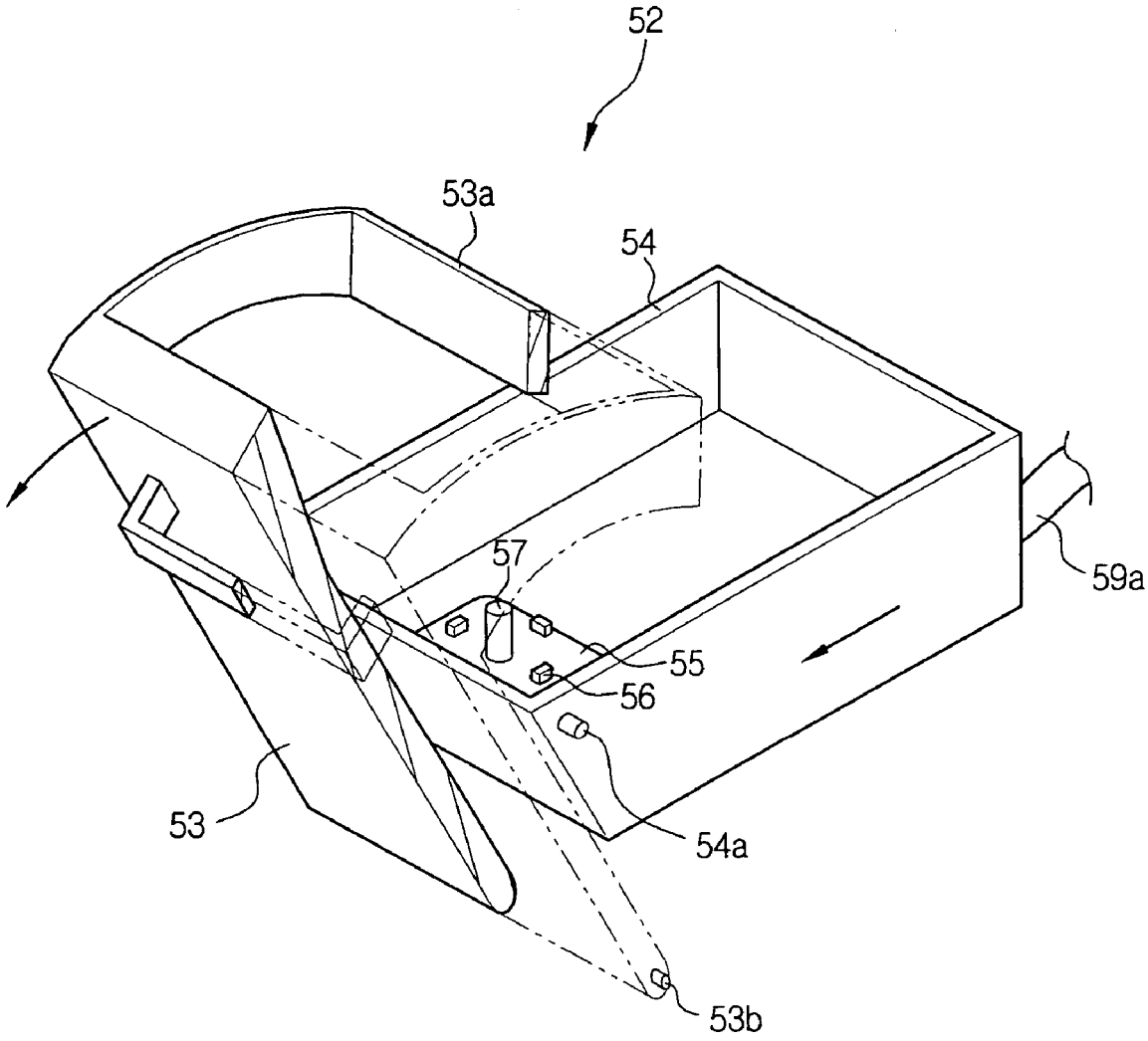
FIG. 7 is a perspective view of the water bucket-supporting device of the heating apparatus for cooking of FIG. 1.

As shown in FIGS. 4, 5 and 7, the water bucket-supporting device 52 includes a switching member 53 installed on the upper portion of the front surface of the main body 10 and rotated for opening and closing the front surface of the main body 10, and a water container 54 installed on the inner side of the switching member 53 for receiving an inlet of the water bucket 51 and drawn forwards when the front surface of the main body 10 is opened. Here, a supporting shaft 53*b* of a lower end of the switching member 53 is rotatably connected to an opening formed in the upper portion of the front surface of the main body 10 such that the switching member 53 is rotated in a vertical direction throughout a designated section and opened out of or closed to the front surface of the main body 10. Further, a supporting portion 53*a* for supporting the water bucket 51 is formed on the upper portion of the inner part of the switching member 53 so that the supporting portion 53*a* can receive the inlet of the water bucket 51 under the condition that the switching member 53 is opened out of the front surface of the main body 10.

The water container 54 may have a hexahedral structure as shown having an opened upper surface for forming a space receiving the inlet of the water bucket 51 when the inlet of the water bucket 51 is introduced into the inside of the switching member 53. A supporting shaft 54*a* formed on the upper end of the water container 54 is rotatably connected to the switching member 53 such that the water container 54 is drawn forwardly when the switching member 53 is opened out of the front surface of the main body 10. The water supply pipe 59*a* is connected to the lower end of the rear portion of the water container 54 such that the water in the water container 54 is supplied to the water supply pump 58.

When a user separates the water bucket 51 from the water bucket-supporting device 52, as shown in FIG. 5, the switching member 53 is closed to the front surface of the main body 10, and when the user installs the water bucket 51 on the water bucket-supporting device 52, as shown in FIG. 4, the water bucket 51 is inserted into the water bucket-supporting device 52 such that the inlet of the water bucket 51 is directed to the lower surface of the water bucket-supporting device 52. Here, since the inlet of the water bucket 51 is introduced into the water container 54 and is then supported, the water of the water bucket 51 flows into the water container 54. Accordingly, a designated quantity of water is collected in the water container 54, and, when the water level in the water container 54 reaches the inlet of the water bucket 51, the introduction of the air into the water bucket 51 is interrupted, thereby preventing the water of the water bucket 51 from flowing into the water container 54.

Figure 6:
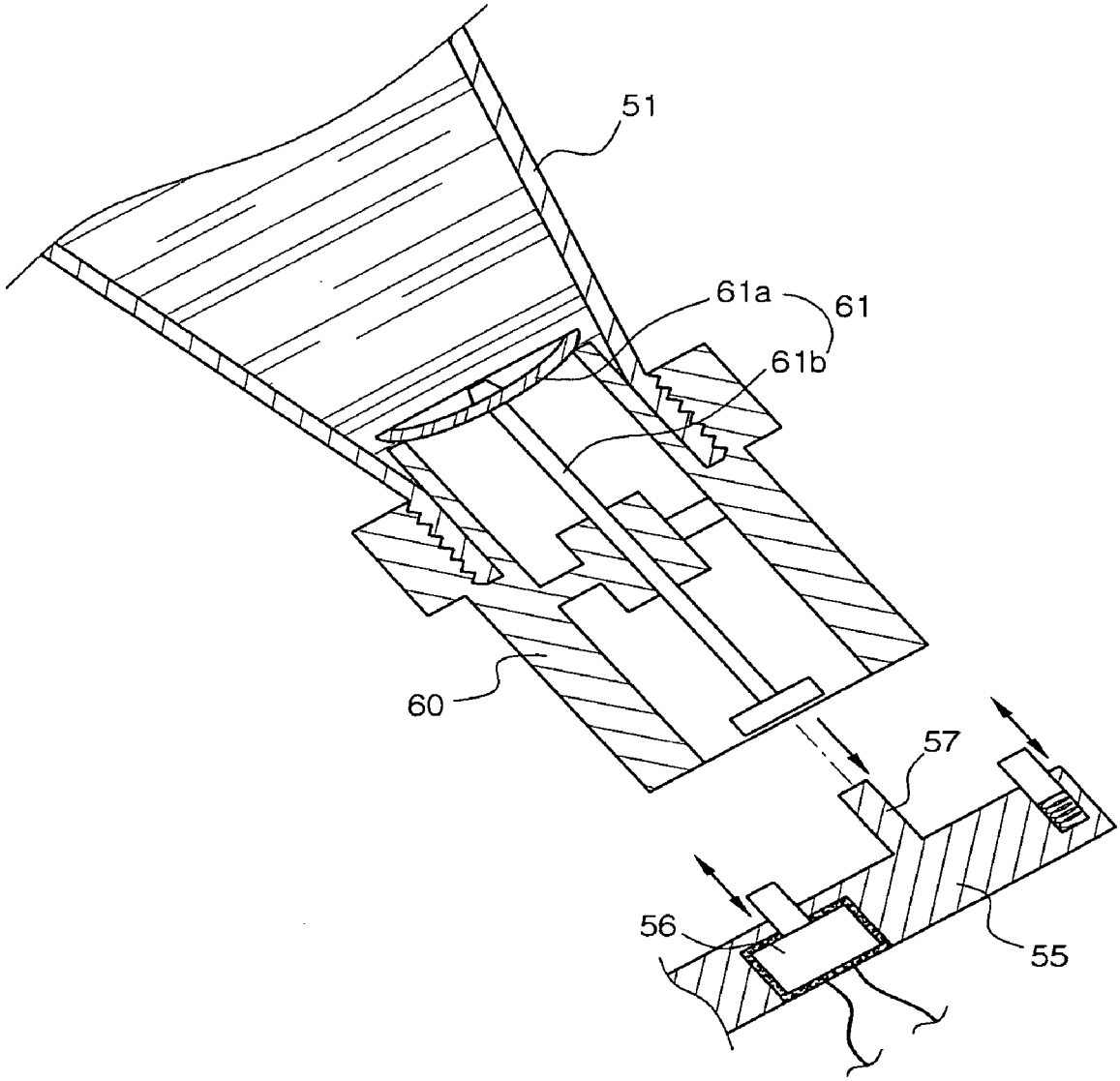
FIG. 6 is a cross-sectional view illustrating the installation of an inlet switching device for opening and closing an inlet of the water bucket and a weight sensor of the heating apparatus for cooking of FIG. 1.

As shown in FIG. 6, the heating apparatus for cooking of the present embodiment also includes an inlet switching device 60 detachably attached to the inlet of the water bucket 51 for opening and closing the inlet of the water bucket 51, and a supporter 55 installed in the inner surface of the water container 54 for supporting the lower end of the inlet switching device 60 when the water bucket 51 is installed in the water bucket-supporting device 52.

The inlet switching device 60 has a cylindrical structure having a designated length, and a valve member 61, for opening the inlet of the water bucket 51 when the water bucket 51 is put into the water container 54 and closing the inlet of the water bucket 51 when the water bucket 51 is taken out of the water container 54, is installed in the inlet switching device 60. The valve member 61 includes a valve plate 61*a* moving back and forth by a designated distance for opening and closing the path of the inlet switching device 60, and a supporting rod 61*b* provided with one end fixed to the valve plate 61*a* and movably supported in the inlet switching device 60 for supporting the valve plate 61*a*. A protrusion 57 is formed on the supporter 55 in the water container 54, and presses the supporting rod 61*b* of the valve member 61 when the water bucket 51 is put into the water container 54, thereby opening the inlet of the water bucket 51.

The above configuration of the inlet switching device 60 prevents water from flowing from the water bucket 51 when the water bucket 51 filled with the water is erected upside down and put into the water container 54, and allows the inlet of the water bucket 51 to be opened after the water bucket 51 is completely put into the water container 54. The inlet switching device 60 may be installed in conventional beverage containers, thereby allowing the conventional beverage containers to serve as water buckets. For this reason, the inlet switching device 60 could have a size suitable for being installed in the inlets of the conventional beverage containers.

As shown in FIG. 6, a weight sensor 56 for sensing the weight of the water bucket 51 is installed in the supporter 55 for supporting the lower end of the inlet switching device 60. The weight sensor 56 determines whether or not the water bucket 51 is installed in the water container 54 and senses the weight of the water bucket 51, thereby sensing the quantity of the water in the water bucket 51.

Hereinafter, the overall operation and control method of the heating apparatus for cooking will be described in detail.

When foods are placed on the shelves 17*a* and 17*b* in the cooking chamber 11 and the heating apparatus for cooking is operated, the upper and lower heaters 16*a* and 16*b* placed at the upper and lower portions of the cooking chamber 11 and the first and second heaters 21 and 22 placed in the hot air chamber 18 are operated and the first and second air blast fans 23*a* and 24*a* are operated. The foods placed in the cooking chamber 11 are heated by heat generated from the upper and lower heaters 16*a* and 16*b* and hot air circulated through the hot air chamber 18 by the operation of the first and second air blast fans 23*a* and 24*a*.

When a user wants to cook foods in the cooking chamber 11 using steam supplied to the cooking chamber 11, the user installs the water bucket 51 on the water bucket-supporting device 52 placed at the upper portion of the cooking chamber 11 and manipulates the operating buttons 15*b* installed on the operating unit 15, thereby operating a steam generation mode. Then, water is supplied from the water container 54 to the heating tank 32 in the hot air chamber 18 by the operation of the water supply pump 58. Steam is generated by heating the steam-generating heater 32 in the heating tank 31, and is then supplied to the cooking chamber 11. Here, the steam is exhausted through the exhaust guide pipes 35*a* and 35*b* and uniformly supplied to the inside of the cooking chamber 11 through air circulating into the hot air chamber 18, thereby preventing the foods from being dried and improving cooking effects.

Water in the heating tank 31 of the steam-generating device 30 of the present embodiment is heated by the first and second heaters 21 and 22 in the hot air chamber 18 as well as the steam-generating heater 32. Accordingly, since the water in the heating tank 31 is rapidly heated and efficiency in generating steam is improved, the steam-generating device 30 employs the steam-generating heater 32 having a low capacity and generates a sufficient quantity of steam.

Figure 8:
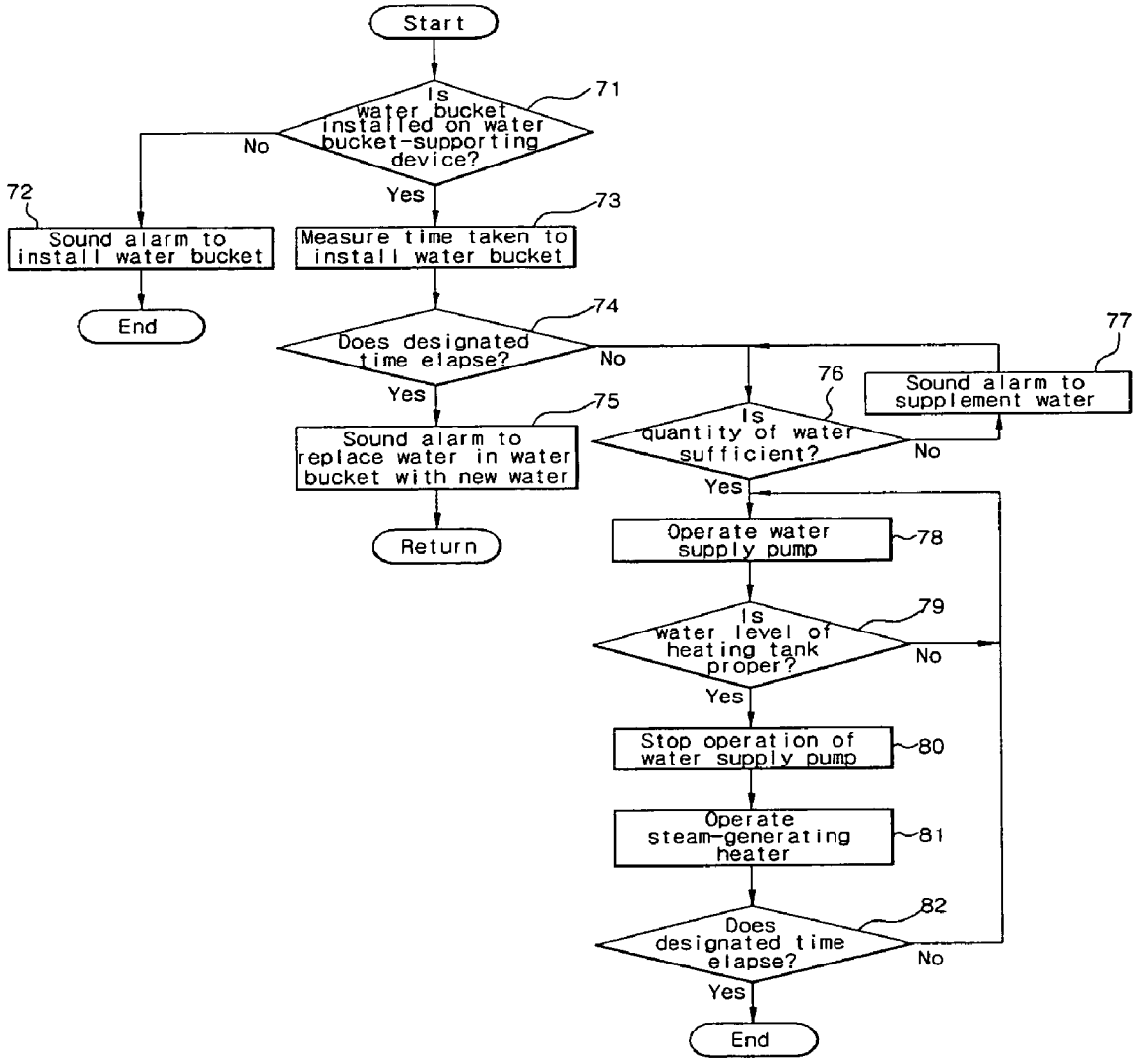
FIG. 8 is a flowchart of a process for controlling the generation of steam in the heating apparatus for cooking in accordance with an embodiment of the present invention.
Figure 9:
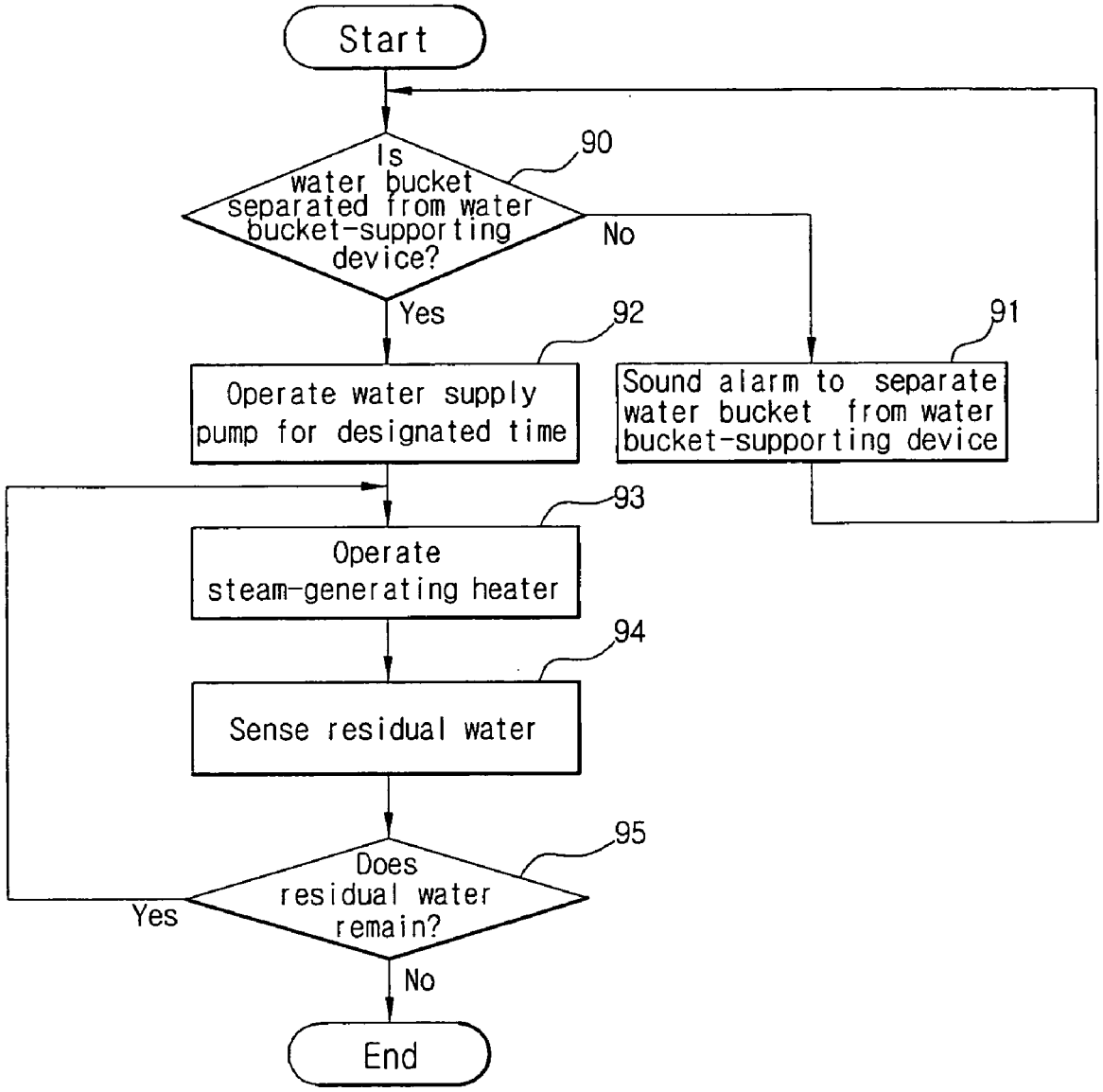
FIG. 9 is a flowchart of a process for controlling the removal of residual water in the heating apparatus for cooking in accordance with an embodiment of the present invention.

FIG. 8 is a flowchart of a process for controlling the generation of steam in the heating apparatus for cooking in accordance with an embodiment of the present invention. Hereinafter, with reference to FIG. 8, the generation of steam will be described in detail. The process of FIG. 8 is performable by the apparatus of FIGS. 1-7 and is, for ease of explanation, described with concurrent reference to those figures. However, it is to be understood that the process of FIG. 9 is performable by other apparatuses.

When a user manipulates a steam-generating button so as to generate steam, a controller (not shown) determines whether or not the water bucket 51 is installed on the water bucket-supporting device 52 using the weight sensor 56 placed in the water container 54 of the water bucket-supporting device 52 (S71). When it is determined that the water bucket 51 is not installed on the water supporting device 52, the controller sounds an alarm to the user (S72), and terminates the process. Here, the alarm is displayed through the display 15*a* installed on the upper portion of the front surface of the main body 10, or is raised through a separate speaker (not shown) or on-and-off lamp (not shown).

When it is determined that the water bucket 51 is installed on the water bucket-supporting device 52, the controller measures time elapsed from the time when the water bucket 51 is installed in the water container 54 (S73). Thereby, it is possible to know how long it has been since water in the water bucket 51 was replaced with new water. Then, the controller determines whether or not the time elapsed from the installation of the water bucket 51 exceeds a designated time (for example, 72 hours, etc.) (S74). When it is determined that the designated time has elapsed, the controller sounds an alarm to replace the water in the water bucket 51 with new water to the user (S75). Such an alarm informs the user of the deterioration of the water, which may be generated after a long period of time from the installation of the water bucket 51, thereby allowing the user to replace the water in the water bucket 51 with new water. Then the process returns to operation S71.

When it is determined that the designated time has not elapsed, the controller determines whether or not the quantity of the water in the water bucket 51 is sufficient using the weight sensor 56 installed in the water container 54 (S76). Then, when it is determined that the quantity of the water is insufficient, the controller sounds an alarm to supplement water (S77). Conversely, in case that it is determined that the quantity of the water is sufficient, the controller operates the water supply pump 58 so that water is supplied from the water container 54 to the heating tank 31 (S78).

When the water is supplied to the heating tank 31, the controller senses the level of the water in the heating tank 31 using the water level sensor 33 of the heating tank 31, and determines whether or not the sensed level of the water is proper (S79). When the level of the water of the heating tank 58 is improperly low, the controller continuously operates the water supply pump 58, and when the level of the water of the heating tank 58 is proper, the controller stops the operation of the water supply pump 58 (S80) and operates the steam-generating heater 32 so as to generate steam. The controller determines whether or not time designated by the user has elapsed (S82). When it is determined that the designated time has elapsed, the controller terminates the process, and when it is determined that the designated time has not elapsed, the controller continuously performs the water supply (S78) and operates the steam-generating heater 32 (S81).

When the heating apparatus for cooking of the present embodiment does not perform the function of generating steam, the heating apparatus for cooking performs a function of removing residual water through the manipulation of the operating unit 15 so that the water in the water bucket-supporting device 52 and residual water in the heating tank 32 are removed, thereby being hygienically used.

Hereinafter, with reference to FIG. 9, a process for controlling the removal of residual water will be described in detail. The process may be performed by the apparatus of FIGS. 1-7 and is, for ease of explanation, described with reference to those figures. However, it is to be understood that the process can be performed by other apparatuses.

When the user manipulates the operating unit 15 for removing the residual water, the controller determines whether or not the water bucket 15 is separated from the water bucket-supporting device 52 using the weight sensor 56 (S90). When it is determined that the water bucket 51 is not separated from the water bucket-supporting device 52, the controller sounds an alarm to separate the water bucket 51 from the water bucket-supporting device 52 (S91). When it is determined that the water bucket 51 is separated from the water bucket-supporting device 52, the controller operates the water supply pump 58 for a designated time so that all of the residual water in the water container 54 is supplied to the heating tank 31 (S92). Here, the operating time of the water supply pump 58 is sufficient to exhaust the water in the water container 54 to the outside.

After the operation of the water supply pump 58, the controller operates the steam-generating heater 32 in the heating tank 31, thereby evaporating the water in the heating tank 31. During the operation of the steam-generating heater 32, the controller senses the level of the water of the heating tank 31 using the water level sensor 33 (S94) and determines whether or not residual water remains in the heating tank 31 (S95). When it is determined that residual water remains in the heating tank 31, the controller continuously operates the steam-generating heater 32, and when it is determined that the residual water does not remain in the heating tank 31, the controller terminates the operation of the steam-generating heater 32.

The above-described embodiment of the present invention provides a heating apparatus for cooking having a water bucket of a water supply device, which is easily attached to and detached from the heating apparatus for cooking so that water supply is easily achieved, and is made of a transparent material and exposed to the outside so that a user can easily know when water is supplied.

Further, the heating apparatus for cooking of the above-described embodiment of the present invention completely removes residual water remaining in a steam-generating device and a water bucket-supporting device after steam-cooking is terminated, thereby being used hygienically.

Moreover, when a function of generating steam is performed after a designated time from the installation of the water bucket has elapsed, the heating apparatus for cooking of the present invention sounds an alarm indicating a time for replacing water with new water, thereby being used conveniently.

Although an embodiment of the present invention have been shown and described, the present invention is not limited to the described embodiment. Instead, it would be appreciated by those skilled in the art that changes may be made to the embodiment without departing from the principles and spirit of the invention, the scope of which is defined by the claims and their equivalents.

What is claimed is:

1. A method of controlling a heating apparatus for cooking which includes a main body having a cooking chamber, a steam-generating device for supplying steam to the cooking chamber, and a water supply device for supplying water to the steam-generating device and having a water bucket detachably attached to the main body for containing water, a sensor for determining whether or not the water bucket is attached to the main body and sensing a weight of the water bucket, and a water supply pump for supplying water to the steam-generating device, the method comprising:

determining whether the water bucket is installed on the main body using the sensor on receipt of a steam generating instruction;

measuring an elapsed time since an installation of the water bucket when the water bucket is determined to be installed on the main body;

determining whether the elapsed time exceeds a designated time; and sounding an alarm when the elapsed time is determined to exceed the designated time.

2. The method according to claim 1, further comprising sounding an alarm when the water bucket is not determined to be installed on the main body.

3. The method according to claim 1, further comprising operating the water supply pump supplying water to the steam-generating device when the elapsed time does not exceed a designated time.

4. The method according to claim 3, further comprising determining whether a quantity of the water in the water bucket is sufficient using the sensor before the operation of the water supply pump, and operating the water supply pump when the quantity of the water in the water bucket is determined to be sufficient.

5. The method according to claim 4, further comprising sounding an alarm to supplement the water when the quantity of the water in the water bucket is determined to be insufficient.

6. A method of controlling a heating apparatus for cooking which includes a main body having a cooking chamber, a steam-generating device for supplying steam to the cooking chamber, the steam-generating device including a heating tank, a water level sensor for sensing a level of water in the heating tank, and a steam-generating heater for heating the water in the heating tank, and a water supply device, for supplying water to the steam-generating device, the water supply device including a water bucket detachably attached to the main body for containing water, an attachment sensor for determining whether the water bucket is attached to the main body and sensing a weight of the water bucket, and a water supply pump for supplying water to the steam-generating device, the method comprising:

determining whether the water bucket is separated from the main body using the attachment sensor on receipt of a water removal instruction;

operating the water supply pump for a specified time so that the water of the water bucket-supporting device is supplied to the heating tank when the water bucket is determined to be separated from the main body; and operating the steam-generating heater to convert the water in the heating tank into steam.

7. The method according to claim 6, further comprising:

sensing whether residual water remains in the heating tank using the water level sensor after the operating; and continuously operating the steam-generating heater when the residual water remains in the heating tank, and terminating the operation of the steam-generating heater when the residual water does not remain in the heating tank.

8. The method according to claim 6, further comprising sounding an alarm when the water bucket is not determined to be separated from the main body.

* * * * *